United States Patent [19]

Markowitz et al.

[11] Patent Number: 4,559,539

[45] Date of Patent: Dec. 17, 1985

[54] SPIRAL ANTENNA DEFORMED TO RECEIVE ANOTHER ANTENNA

[75] Inventors: Raymond S. Markowitz, Wyncote; Baruch Even-Or; Walter Bohlman, both of Chalfont, all of Pa.

[73] Assignee: American Electronic Laboratories, Inc., Landsdale, Pa.

[21] Appl. No.: 514,763

[22] Filed: Jul. 18, 1983

[51] Int. Cl.[4] ..... H01Q 1/36

[52] U.S. Cl. ..... 343/725; 343/895

[58] Field of Search ..... 343/895, 725–728, 343/893, 868

[56] References Cited

U.S. PATENT DOCUMENTS

| | | | |
|---|---|---|---|
| 2,856,605 | 10/1958 | Jacobsen | 343/895 |
| 2,953,781 | 9/1960 | Donnellan et al. | 343/895 |
| 2,958,081 | 10/1960 | Dyson | 343/895 |
| 2,977,594 | 3/1961 | Marston et al. | 343/895 |
| 2,990,548 | 6/1961 | Wheeler | 343/895 |
| 3,017,633 | 1/1962 | Marston et al. | 343/895 |
| 3,188,643 | 6/1965 | Dyson et al. | 343/895 |
| 3,257,660 | 6/1966 | Schneider | 343/895 |
| 3,343,089 | 9/1967 | Murphy et al. | 343/895 |
| 3,530,486 | 9/1970 | Strider | 343/895 |
| 3,681,772 | 8/1972 | Ingerson | 343/895 |
| 3,683,385 | 8/1972 | Corzine et al. | 343/895 |
| 3,699,452 | 10/1972 | Lindenmeier et al. | 343/895 |
| 3,713,163 | 1/1973 | Keller et al. | 343/895 |
| 3,787,871 | 1/1974 | Reese | 343/895 |
| 4,051,481 | 9/1977 | Abreu | 343/895 |
| 4,095,230 | 6/1978 | Salmond et al. | 343/895 |
| 4,243,993 | 1/1981 | Lamberty et al. | 343/895 |
| 4,319,248 | 3/1982 | Flam | 343/895 |

FOREIGN PATENT DOCUMENTS

| | | |
|---|---|---|
| 2707819 | 2/1977 | Fed. Rep. of Germany . |
| 1498364 | 1/1978 | United Kingdom . |

*Primary Examiner*—Eli Lieberman
*Assistant Examiner*—Michael C. Wimer
*Attorney, Agent, or Firm*—Seidel, Gonda, Goldhammer & Abbott

[57] ABSTRACT

A spiral antenna has a plurality of interleaved radiating elements winding outwardly in a spiral pattern about a common axis. The spiral pattern is deformed at outer regions of the antenna to define one or more circumferentially disposed concavities in the body of the antenna. Each concavity is adapted to receive another antenna such as a spiral antenna or horn antenna.

24 Claims, 5 Drawing Figures

FIG. 1
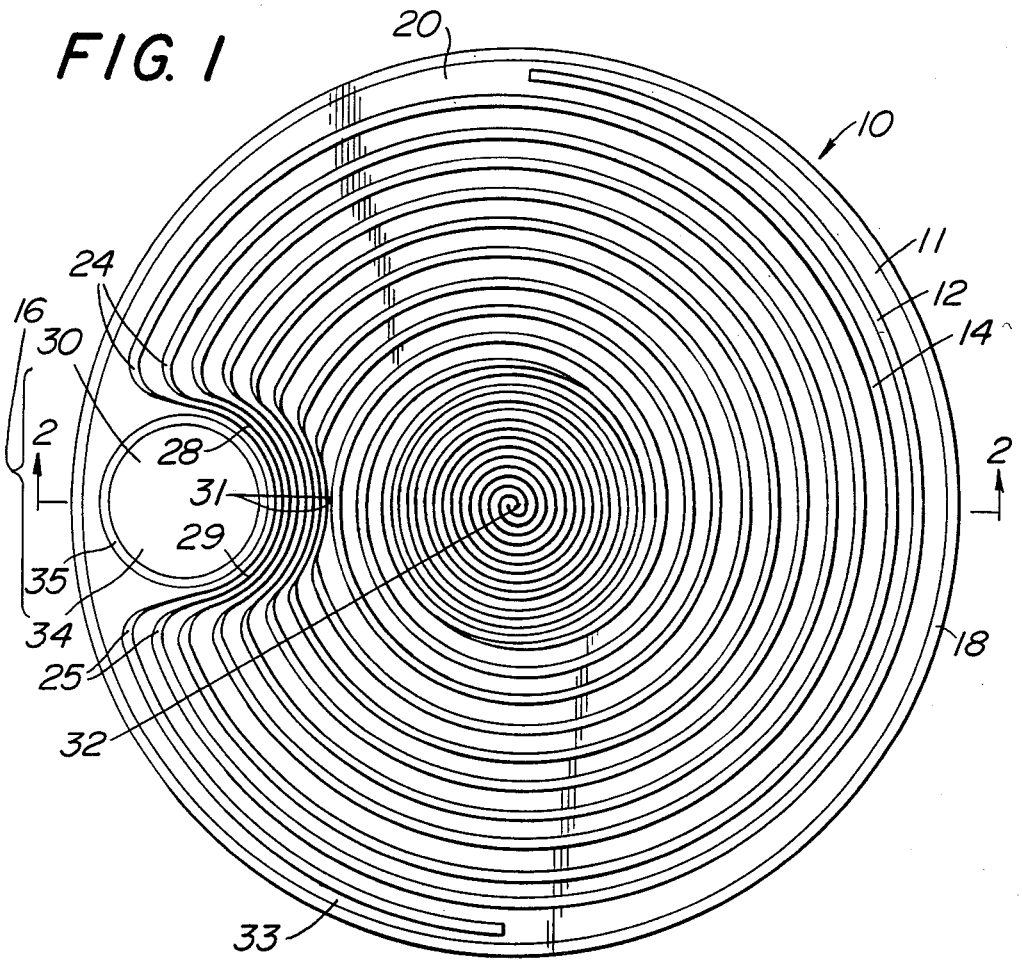
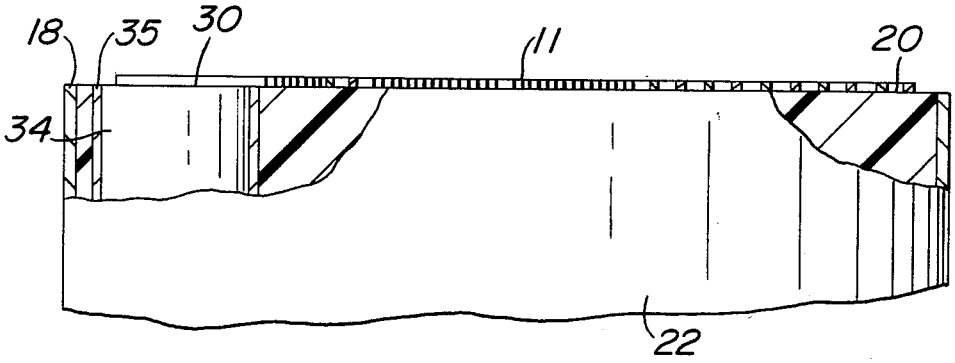
FIG. 2

FIG. 3
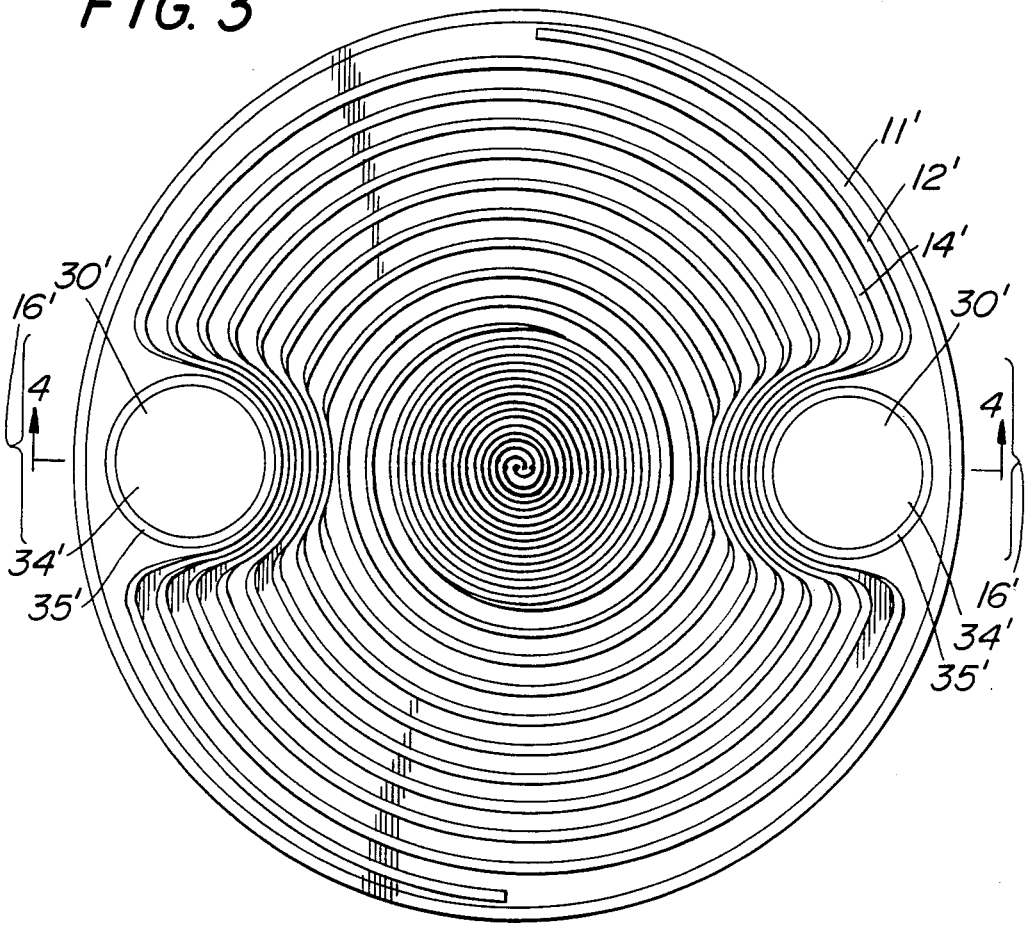
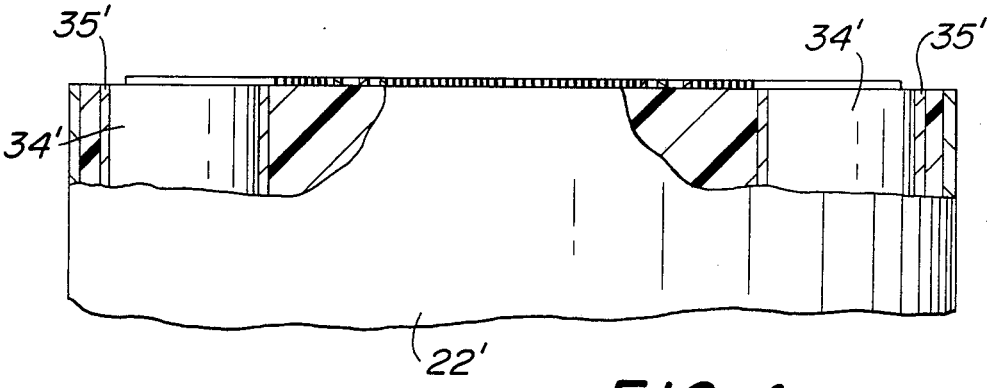
FIG. 4

SPIRAL ANTENNA DEFORMED TO RECEIVE ANOTHER ANTENNA

BACKGROUND OF THE INVENTION

The present invention is directed generally to antennas. More particularly, the invention is directed to a spiral antenna having one or more voids wherein each void is adapted to receive another antenna.

Spiral antennas are known. See, for example, U.S. Pat. Nos. 2,856,605, 2,977,594 and 4,243,993. It is also known to combine two or more spiral antennas to form an antenna array. See U.S. Pat. Nos. 3,017,633 and 3,530,486. Still further it is known to combine spiral antennas having different bandwidths to form a broadband antenna system. See, for example, U.S. Pat. No. 4,095,230.

A problem with known broadband antenna systems is that multiple antennas cannot be combined to form a broadband antenna system or array and still fit within the space normally occupied by one of the antennas alone. Thus, replacement of a single antenna with a broadband antenna system or array often requires that the structure housing the original antenna be modified to provide additional space to receive the new antenna system.

The aforementioned problem often manifests itself in the replacement of antennas used in military aircraft. For example, radar warning receivers in military aircraft generally utilize a spiral antenna housed in a spaced provided in the external frame of the aircraft. Typically, the bandwidth of this spiral antenna is 2–18 GHz. Due to the recent appearance of radar signals above 18 GHz., it has become desirable to replace the existing spiral antennas with a broadband antenna system having an overall bandwidth of approximately 2–100 GHz. Known antenna systems covering this increased bandwidth generally comprise an array of spiral antennas which will not fit in the space currently provided for the existing spiral antenna. Therefore to install the new antenna system, it is necessary to modify the external frame of the aircraft by increasing the amount of space provided for the existing spiral antenna. This modification to the aircraft frame is undesirable because it is costly and time consuming.

It is therefore desirable to combine a number of antennas to form a broadband antenna system which occupies the space normally occupied by one of the antennas alone.

SUMMARY OF THE INVENTION

A host spiral antenna ("host") comprises one or more spiral arms. Each spiral arm has a plurality of windings. One or more of the spiral arm windings are deformed in a controlled manner at outer regions of the host so that they define one or more voids in the body of the host. Preferably, the voids are in the form of concavities or apertures circumferentially disposed in the body of the host. Each void is an antenna accepting region adapted to receive another antenna ("complementary antenna") such as a spiral antenna, a horn antenna, or any other suitable antenna, having a desired bandwidth. The composite antenna, i.e., the host together with the complementary antenna(s), is an antenna system having a bandwidth equal to the combined bandwidths of the host and complementary antenna(s).

It is an object of this invention to provide an antenna having means for receiving one or more additional antennas wherein the space occupied by the composite does not exceed the space normally occupied by one of the antennas alone.

It is a further object of this invention to provide an antenna system comprising a host antenna and one or more complementary antennas wherein the antenna system fits within the space normally occupied by the host antenna alone and has a bandwidth equal to the combined bandwidths of the host and complementary antenna(s).

BRIEF DESCRIPTION OF THE DRAWINGS

For the purpose of ilustrating the invention, there is shown in the drawings a form which is presently preferred; it being understood, however, that this invention is not limited to the precise arrangements and instrumentalities shown.

FIG. 1 is a top plan view of a spiral antenna having a single antenna accepting region.

FIG. 2 is a sectional view taken along line 2—2 of FIG. 1.

FIG. 3 is a top plan view of a spiral antenna having two antenna accepting regions.

FIG. 4 is a sectional view taken along line 4—4 of FIG. 3.

DETAILED DESCRIPTION OF THE INVENTION

Figure 5:
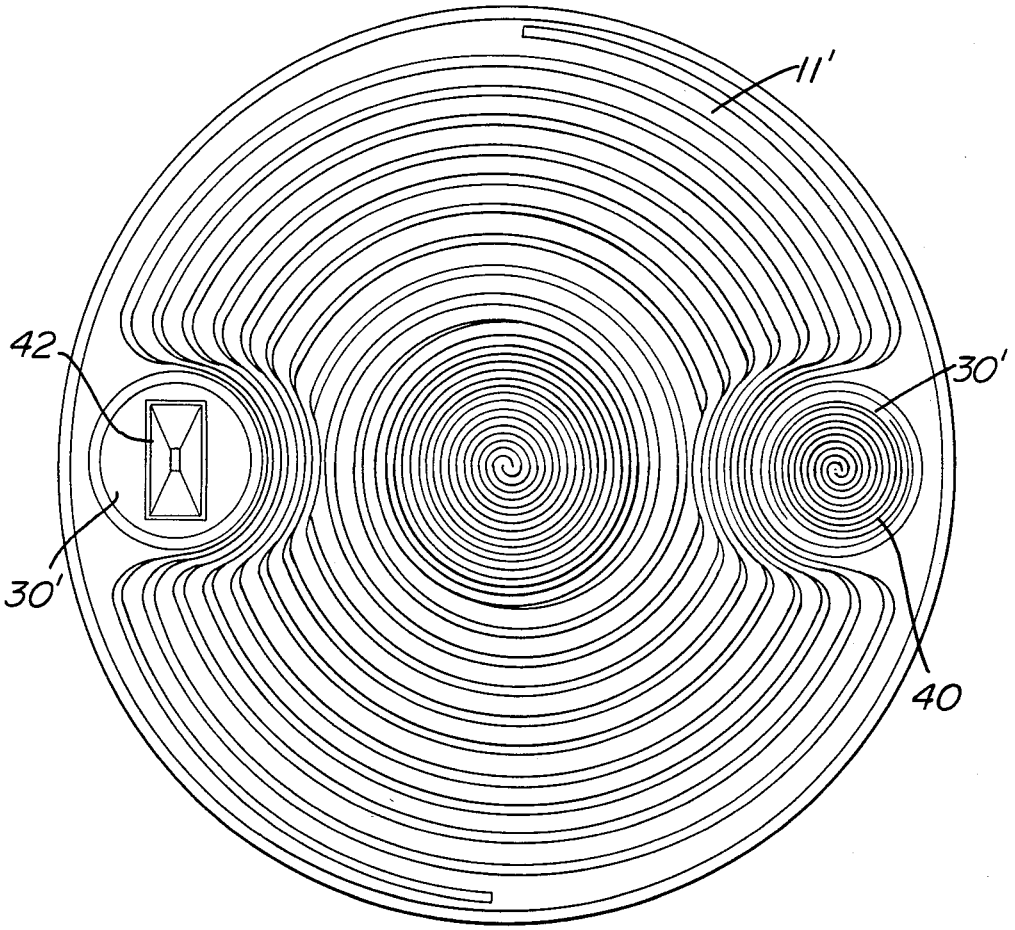
FIG. 5 is a top plan view of the host antenna having a complementary spiral antenna in one antenna accepting region and complementary horn antenna in another antenna accepting region.

Referring now to the drawings, wherein like numerals represent like elements, there is shown in FIG. 1 an antenna system 10 constructed according to the principles of the present invention. The antenna system 10 generally comprises a planar spiral antenna 11 (also referred to as the "host" or "host antenna") housed in a casing 18. The host 11 is shown as having spiral arms in the form of first and second interleaved radiating elements 12 and 14 respectively, although the principles of the present invention are applicable to spiral antennas having any number of radiators. Each radiating element 12, 14 comprises a plurality of windings of a suitable conductor which spirals outwardly about a common central central axis from a central portion 32 of a small radius to an outer portion 33 of a larger radius in conventional manner, except as noted herein. The radiating elements 12, 14 may be either center fed or end fed, as desired.

The radiating elements 12, 14 are typified herein as printed circuit conductors mounted upon a base member 20 of insulating material, such as a pattern etched on a printed circuit board. However, it should be understood that the principles of the present invention are not restricted to the illustrated embodiment, but are applicable to all spiral antennas, including by way of example but not limitation wire wound spiral antennas.

The radiating elements 12, 14 spiral outwardly in a common plane in conventional manner except in the vicinity of a region 16 where the spiral pattern of several windings of the radiating elements 12, 14 is deformed. A number of the windings entering region 16 depart from their spiral path and smoothly proceed via a curved path 24 and then along a generally circular path 28 into the body of antenna 11. The deformed windings continue along path 28 into the body of antenna 11 until they reach an imaginery radial line 31. At line 31, the deformed windings begin to exit the body of antenna 11 along a generally circular path 29, which is a continuation of path 28. The deformed windings smoothly exit region 16 via a curved path 25 and thereafter resume their normal spiral path. Preferably, for each winding, the radius of curvature of path 24 is identical to the radius of curvature of corresponding path 25 and the length of arc swept by path 28 is identical to the length of arc swept by corresponding path 29. Together, each circular path 28, 29 forms a substantially concave path through the body of antenna 11. As shown, the radial width of each winding of radiating elements 12, 14 decreases substantially along path 24 and has minimum radial width along path 28, 29. The windings regain their normal radial width as they exit region 16 along path 25.

The deformity caused by concave path 28, 29 define a void 30 in the body of antenna 11. In the typified embodiment, the void 30 is partially bounded by the concave path 28, 29 and is a concavity or aperture which is circumferentially disposed in the body of antenna 11. As shown, the concavity opens in a direction away from the central portion 32.

The void 30 is an antenna accepting region adapted to receive another antenna ("complementary antenna"). See FIG. 5. The complementary antenna may be a spiral antenna 40, a horn antenna 42, or any other antenna having a desired bandwidth. The size of the antenna accepting region provided by the void 30 will determine the maximum size or diameter of a complementary antenna which will fit therein. The host antenna can be designed to have an antenna accepting region of sufficient size or diameter to receive the desired range of complementary antenna by suitably deforming the windings in the inventive manner. It should be understood that the number of spiral arm windings which are deformed will be determined by the desired size of the antenna accepting region.

The following criteria should be followed in constructing a host antenna according to the present invention.

1. The rate of change of the curvature of each spiral arm winding should be kept finite. Thus, there should be no discontinuities in the slope of the curve defined by the path of each spiral arm winding, particularly along paths 24 and 25.

2. The ratio of the radial width of each spiral arm winding (i.e. the radial width of one of radiating elements 12 or 14 at any point along the path) to the radial width of the space between adjacent windings (i.e. the radial width between adjacent radiating elements 12, 14 at the same point along the path) should be a constant for the entire antenna 11. The ratio should be maintained in both normal and deformed regions of the host antenna 11.

3. As the windings proceed from their normal spiral path into the deformed region 16, the decrease in the radial width of the windings along path 24 should be smooth and continuous such that a smooth impedance transformation results. Similarly, as the windings exit the deformed region 16 along path 25, the increase in the radial width of the windings should be smooth and continuous such that a smooth impedance transformation results.

4. The length of each radiating element in the host should be substantially similar.

In a typical embodiment of the present invention, the host antenna 11 has a bandwidth of 2–18 GHz and a complementary antenna has a bandwidth of 18–100 GHz. The bandwidth of the composite antenna is therefore 2–100 GHz. In this embodiment, the diameter of the host antenna is approximately 2.4 inches and the void 30 measures approximately 0.5 inch in a diameter. For this particular embodiment, the ratio of winding width to winding spacing is 4 to 1 through the host.

To facilitate installation of the complementary antenna in the body of the host antenna 11, the base member 20 may have a circular opening 34 in the space of the antenna accepting region. As shown, the opening 34 is provided with a boundary 35 for mounting the complementary antenna to the base member. However, it should be understood that the opening 34 is not necessary and that complementary antenna may be disposed directly on the base member 20. For example, the complementary antenna could be a printed circuit conductor etched on the same printed circuit board as host 11.

FIG. 2 illustrates details of a housing for an antenna system according to the typified embodiment. As shown, the base member 20 containing the host 11 is mounted in a casing 18 having an outer wall 22. The opening 34 (if provided) continues through the casing 18 to define a cylindrical housing having outer boundary walls 35 which receive the complementary antenna.

FIG. 3 illustrates a spiral antenna 11' according to the principles of the present invention but the host 11' is provided with two voids 30' at two regions 16', each void 30' defining a separate antenna accepting region. Each void 30' is partially bounded by at least one of the radiating elements 12', 14', as shown. The host 11' is thus adapted to receive two complementary antennas, each of which may have a different bandwidth. See FIG. 5. For example, the host may have a bandwidth of 2–18 GHz, one of the complementary antennas 40 may have a bandwidth of 18–100 GHz and the other complementary antenna 42 may have a bandwidth of 100–150 GHz, providing an overall combined bandwidth of 2–150 GHz for the composite antenna.

It will be appreciated that, subject to practical limitations, the host 11' antenna may be provided with any number of antenna accepting regions so that three or more complementary antennas may be combined with the host antenna 11'.

FIG. 4 illustrates a casing 22' adapted to house the multi-aperture antenna 11'. As shown, casing 22' contains two openings 34' which coincide with the two antenna accepting regions in the host 11'.

It should be understood that the host and complementary antennas may be electrically connected by means of a suitable matching network. Alternatively, the host and complementary antennas may not be connected together but instead each may be connected to a different piece of radio or radar equipment.

It has been found that the performance of the host antenna is substantially unaffected by deforming the pattern of the windings in the inventive manner. Thus, the host antenna exhibits performance characteristics substantially identical to the original spiral antenna from which the host antenna is derived. The present invention therefore allows two or more antennas to be combined in a system or array which occupies the space normally occupied by one antenna alone without significantly altering the performance of the individual antennas.

The present invention may be embodied in other specific forms without departing from the spirit or essential attributes thereof and, accordingly, reference should be made to the appended claims, rather than to the foregoing specification, as indicating the scope of the invention.

We claim:

1. An antenna comprising at least one radiating element wound in a generally spiral pattern, said radiating element departing from said spiral pattern and curving radially inward toward the center of said spiral pattern in at least one region so as to define at least one void only partially bound by said radiating element at said region, said void being adapted to receive another antenna.

2. An antenna according to claim 1 wherein said radiating element curves in a generally concave path at said region.

3. An antenna according to claim 2 wherein said radiating element is planar and spirals about a central axis, said radiating element having a first radial width along said spiral pattern and a second radial width along said concave path, said first radial width being greater than said second radial width, said radiating element having a smooth and continuous transition between said first and second radial widths.

4. An antenna according to claim 3 wherein said region is an outer region of said antenna, said void being a circumferentially disposed concavity.

5. An antenna according to claim 1 further comprising another antenna disposed in said void.

6. An antenna comprising two or more interleaved radiating elements wound in a generally spiral pattern, said radiating elements departing from said spiral pattern and curving radially inward toward the center of the spiral pattern in at least one region so as to define at least one void, said void being only partially bounded by said radiating elements, said void being adapted to receive another antenna.

7. An antenna according to claim 5 further comprising another antenna disposed in said void.

8. An antenna according to claim 6 wherein said radiating elements curved in a generally concave path at said region.

9. An antenna according to claim 8 wherein said radiating elements are coplanar and spiral about a common axis, said radiating elements having a first radial width along said spiral pattern and a second radial width along said concave path, said first radial width being greater than said second width, said radiating elements having a smooth and continuous transition between said first and second radial widths.

10. An antenna according to claim 9 wherein said region is an outer region of said antenna, said void being a circumferentially disposed concavity.

11. A host antenna comprising a plurality of interleaved radiating elements, each radiating element winding outwardly in a spiral path, said spiral path of each radiating element curving radially inward toward the center of said spiral path at selected regions and defining two or more circumferentially disposed concavities.

12. An antenna according to claim 11 further comprising a plurality of complementary antennas, each complementary antenna being disposed in one of said concavities.

13. An antenna according to claim 12 wherein said complementary antennas are spiral antennas.

14. An antenna according to claim 12 wherein said complementary antennas are horn antennas.

15. An antenna according to claim 11 wherein said radiating elements are coplanar and spiral about a common axis, said radiating elements curving in a generally concave path at said selected regions, thereby defining said concavities, said radiating elements having a first radial width along said spiral path and a second radial width along said concave path, said first radial width being greater than said second radial width, said radiating elements having a smooth and continuous transition between said first and second radial widths.

16. A spiral antenna comprising a plurality of interleaved conductors winding outwardly in a generally spiral pattern, said conductors departing from said spiral pattern and extending in a generally concave path toward the center of said spiral pattern to define at least one circumferentially dispose concavity in at least one region of said antenna, said concavity being only partially bounded by said conductors, said concavity being adapted to receive another antenna.

17. An antenna according to claim 16 further comprising another antenna disposed in said concavity.

18. A spiral antenna comprising at least a pair of interleaved radiating elements disposed in a common plane, each radiating element being wound in a generally spiral pattern about a common axis, said spiral pattern being deformed in at least one outer region of said antenna such that said radiating elements extend in a generally concave path toward said common axis at said region to define at least one circumferentially disposed concavity at said region, said concavity being adapted to receive another antenna.

19. An antenna according to claim 18 further comprising another antenna disposed in said concavity.

20. An antenna system comprising:

(a) a host antenna having at least one planar radiating element wound in a generally spiral pattern, said pattern being deformed such that said radiating element curves radially inward toward the center of said spiral pattern in at least one selected region so as to define at least one void only partially bounded by said radiating element at said region, said void being an antenna accepting region;

(b) at least one commplementary antenna adapted to be received by said antenna accepting region.

21. An antenna system according to claim 20 wherein said complementary antenna is a spiral antenna.

22. An antenna system according to claim 20 wherein said complementary antenna is a horn antenna.

23. A method of constructing a spiral antenna comprising:

(a) providing at least one conductor;

(b) winding said conductor in a generally spiral pattern about a central axis;

(c) deforming said spiral pattern by causing said conductor to extend in a generally concave path toward said central axis in at least one outer region of said antenna, thereby defining one or more circumferentially disposed concavities which are only partially bound by said conductor.

24. A method of constructing a spiral antenna according to claim 23 further comprising the step of placing another antenna in said circumferentially disposed concavity.

* * * * *